US010795290B2

(12) United States Patent
Mamiya

(10) Patent No.: US 10,795,290 B2
(45) Date of Patent: Oct. 6, 2020

(54) FIXATION APPARATUS AND IMAGE FORMING APPARATUS

(71) Applicant: Konica Minolta, Inc., Tokyo (JP)

(72) Inventor: Yusuke Mamiya, Nagoya (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/378,877

(22) Filed: Apr. 9, 2019

(65) Prior Publication Data

US 2019/0324390 A1 Oct. 24, 2019

(30) Foreign Application Priority Data

Apr. 19, 2018 (JP) ..... 2018-080578

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 2215/2022; G03G 2215/2035; G03G 2215/2038
See application file for complete search history.

(56) References Cited

U.S. PATENT DOCUMENTS 5,162,634 A * 11/1992 Kusaka ..... G03G 15/2064 219/216
5,262,834 A * 11/1993 Kusaka ..... G03G 15/2003 219/216
6,795,678 B2 * 9/2004 Yura ..... G03G 15/2064 219/216
10,203,636 B1 * 2/2019 Inomata ..... G03G 15/2028
2001/0019676 A1 * 9/2001 Okubo ..... G03G 15/2064 399/328
2002/0051659 A1 * 5/2002 Baba ..... G03G 15/161 399/307
2003/0049056 A1 * 3/2003 Finn ..... G03G 15/2057 399/333
2003/0183610 A1 * 10/2003 Okabayashi ..... G03G 15/2064 219/216

(Continued)

FOREIGN PATENT DOCUMENTS

JP 2001-083826 A 3/2001
JP 2010-204551 A 9/2010
JP 2015-184291 A 10/2015

*Primary Examiner* — David J Bolduc
(74) *Attorney, Agent, or Firm* — Lucas & Mercanti, LLP

(57) ABSTRACT

A fixation apparatus includes an endless fixation belt, a pad portion, an opposing rotating body, a heat source, a tensioned support portion, a support portion, and an opposing portion. The tensioned support portion supports the fixation belt under tension. The support portion is arranged downstream from a fixation nip portion in a direction of rotation of the fixation belt, and supports the fixation belt from an inner circumferential side of the fixation belt. The opposing portion is arranged as being opposed to an outer circumferential surface of the fixation belt with a space being interposed. The support portion includes a contact area where the support portion and an inner circumferential surface of the fixation belt are in contact with each other. The opposing portion is arranged as being opposed to the contact area.

13 Claims, 12 Drawing Sheets

(56) References Cited

U.S. PATENT DOCUMENTS

2004/0184847 A1* 9/2004 Oonishi ..... G03G 15/206 399/329
2004/0184849 A1* 9/2004 Yonekawa ..... G03G 15/2064 399/329
2004/0184850 A1* 9/2004 Yoneda ..... G03G 15/2064 399/329
2004/0184851 A1* 9/2004 Otsuka ..... G03G 15/2053 399/329
2005/0191071 A1* 9/2005 Katayanagi ..... G03G 15/206 399/45
2006/0008283 A1* 1/2006 Oohara ..... G03G 15/2028 399/45
2006/0127142 A1* 6/2006 Nakamoto ..... G03G 15/2053 399/329
2007/0166084 A1* 7/2007 Yoshino ..... G03G 15/2042 399/329
2008/0112736 A1* 5/2008 Kimura ..... G03G 15/2053 399/328
2008/0240807 A1* 10/2008 Lee ..... G03G 15/2064 399/329
2008/0253814 A1* 10/2008 Suzuki ..... G03G 15/2039 399/320
2008/0304882 A1* 12/2008 Shin ..... G03G 15/2053 399/329
2009/0035034 A1* 2/2009 Nagase ..... G03G 15/2025 399/329
2009/0052925 A1* 2/2009 Fujimoto ..... G03G 15/206 399/67
2010/0172677 A1* 7/2010 Hosokawa ..... G03G 15/2064 399/329
2011/0064451 A1* 3/2011 Yamaguchi ..... G03G 15/2028 399/99
2011/0085832 A1* 4/2011 Hasegawa ..... G03G 15/2032 399/329
2011/0116848 A1* 5/2011 Yamaguchi ..... G03G 15/2064 399/329
2011/0135351 A1* 6/2011 Kurita ..... G03G 15/2028 399/323
2011/0135358 A1* 6/2011 Kikuchi ..... G03G 15/2064 399/329
2011/0206427 A1* 8/2011 Iwaya ..... G03G 15/2053 399/329
2011/0211876 A1* 9/2011 Iwaya ..... G03G 15/2028 399/323
2011/0311284 A1* 12/2011 Seo ..... G03G 15/2032 399/329
2012/0114345 A1* 5/2012 Fujimoto ..... G03G 15/2017 399/44
2012/0121304 A1* 5/2012 Tokuda ..... G03G 15/2039 399/329
2012/0148303 A1* 6/2012 Yamaguchi ..... G03G 15/2053 399/122
2012/0251208 A1* 10/2012 Hasegawa ..... G03G 15/2017 399/329
2013/0084088 A1* 4/2013 Sakai ..... G03G 15/2064 399/45
2013/0084117 A1* 4/2013 Nishida ..... G03G 15/2028 399/381
2013/0189005 A1* 7/2013 Saito ..... G03G 15/2053 399/323
2013/0243501 A1* 9/2013 Chiba ..... G03G 15/2028 399/329
2013/0330111 A1* 12/2013 Tokuda ..... G03G 15/6576 399/329
2014/0241766 A1* 8/2014 Ishii ..... G03G 15/2025 399/329
2014/0286683 A1* 9/2014 Nakamura ..... G03G 15/2053 399/329
2014/0369727 A1* 12/2014 Tsunoda ..... G03G 15/2064 399/329
2015/0055993 A1* 2/2015 Shoji ..... G03G 15/2053 399/329
2015/0055994 A1* 2/2015 Shoji ..... G03G 15/2053 399/329
2015/0309455 A1* 10/2015 Matsumoto ..... G03G 15/2028 399/323
2015/0323891 A1* 11/2015 Okuno ..... G03G 15/20 399/33
2015/0355585 A1* 12/2015 Suzuki ..... G03G 15/2053 399/329
2016/0246227 A1* 8/2016 Ishimori ..... G03G 15/2032
2017/0364006 A1* 12/2017 Minemura ..... G03G 15/2053
2018/0011435 A1* 1/2018 Tsubotani ..... G03G 15/2028
2018/0081310 A1* 3/2018 Tsubotani ..... G03G 15/2025
2019/0064710 A1* 2/2019 Tsubotani ..... G03G 15/206
2019/0137916 A1* 5/2019 Sonoyama ..... G03G 15/2053
2019/0235422 A1* 8/2019 Yabuki ..... G03G 15/2028
2019/0235428 A1* 8/2019 Yabuki ..... G03G 15/2053
2019/0286040 A1* 9/2019 Arai ..... G03G 15/553

* cited by examiner

FIXATION APPARATUS AND IMAGE FORMING APPARATUS

The entire disclosure of Japanese Patent Application No. 2018-080578 filed on Apr. 19, 2018 is incorporated herein by reference in its entirety.

BACKGROUND

Technological Field

The present invention relates to a fixation apparatus and an image forming apparatus.

Description of the Related Art

Japanese Laid-Open Patent Publications Nos. 2001-83826, 2010-204551, and 2015-184291 disclose a technique relating to a fixation apparatus configured such that an endless fixation belt is supported under tension.

SUMMARY

In the fixation apparatus disclosed in these patent literatures, air which flows with rotation of the fixation belt may flow into the fixation apparatus from a downstream side of a fixation nip portion. Then, a temperature of the fixation belt may be lowered and energy efficiency may become poor.

The present disclosure provides a fixation apparatus and an image forming apparatus capable of achieving suppression of lowering in temperature of a fixation belt due to flow-in of air.

The endless fixation belt disclosed in the patent literatures is supported under tension by a plurality of rollers. Recently, in order to improve energy efficiency, a fixation apparatus including a pad portion arranged on an inner circumferential side of the endless fixation belt has been invented. In the fixation apparatus including the pad portion, a fixation nip portion is formed by the pad portion and a rotating body opposed to the pad portion. In the fixation apparatus including the pad portion, the fixation belt sags on a downstream side of the fixation nip portion in a direction of rotation of the fixation belt.

A tolerance of an outer diameter of the fixation belt and a tolerance of tension with which the fixation belt is supported result in sag of the fixation belt. In particular, a difference in state of tensioned support of the fixation belt between a non-moving state and a driven state of the fixation belt and variation in hardness of the fixation belt due to a temperature greatly affect sag of the fixation belt. Specifically, the fixation belt sags because a state of tensioned support of the fixation belt is greatly different between a state that the fixation belt remains stopped at a room temperature and a state that the fixation belt is driven as being heated.

The present inventors have provided in the fixation apparatus including the pad portion, an opposing portion opposed to an outer circumferential surface of the fixation belt in order to suppress flow of air into the fixation apparatus from a downstream side of the fixation nip portion with rotation of the fixation belt.

As described above, however, in the fixation apparatus including the pad portion, the fixation belt sags on a downstream side of the fixation nip portion in the direction of rotation of the fixation belt. Therefore, taking into account sag of the fixation belt, a large space between the outer circumferential surface of the fixation belt and the opposing portion had to be set. Air has thus been likely to flow into the fixation apparatus through the space and a temperature of the fixation belt has disadvantageously been lowered.

The present inventors have furthered their studies to suppress flow-in of air by setting a small space even in the fixation apparatus including the pad portion and completed a fixation apparatus and an image forming apparatus disclosed below.

To achieve at least one of the abovementioned objects, according to an aspect of the present invention, a fixation apparatus reflecting one aspect of the present invention fixes a toner image formed on a recording medium. The fixation apparatus includes an endless fixation belt, a pad portion, an opposing rotating body, a heat source, a tensioned support portion, a support portion, and an opposing portion. The fixation belt is rotatably constructed. The pad portion is arranged on an inner circumferential side of the fixation belt. The opposing rotating body is opposed to the pad portion and an outer circumferential surface of the fixation belt to form a fixation nip portion. The heat source supplies heat to the toner image. The tensioned support portion supports the fixation belt under tension. The support portion is arranged downstream from the fixation nip portion in a direction of rotation of the fixation belt and supports the fixation belt from the inner circumferential side of the fixation belt. The opposing portion is arranged as being opposed to the outer circumferential surface of the fixation belt with a space being interposed. The support portion includes a contact area where the support portion and an inner circumferential surface of the fixation belt are in contact with each other. The opposing portion is arranged as being opposed to the contact area.

To achieve at least one of the abovementioned objects, according to an aspect of the present invention, an image forming apparatus reflecting one aspect of the present invention comprises the fixation apparatus described above and an accommodation portion which accommodates a recording medium to be transported to the fixation apparatus.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
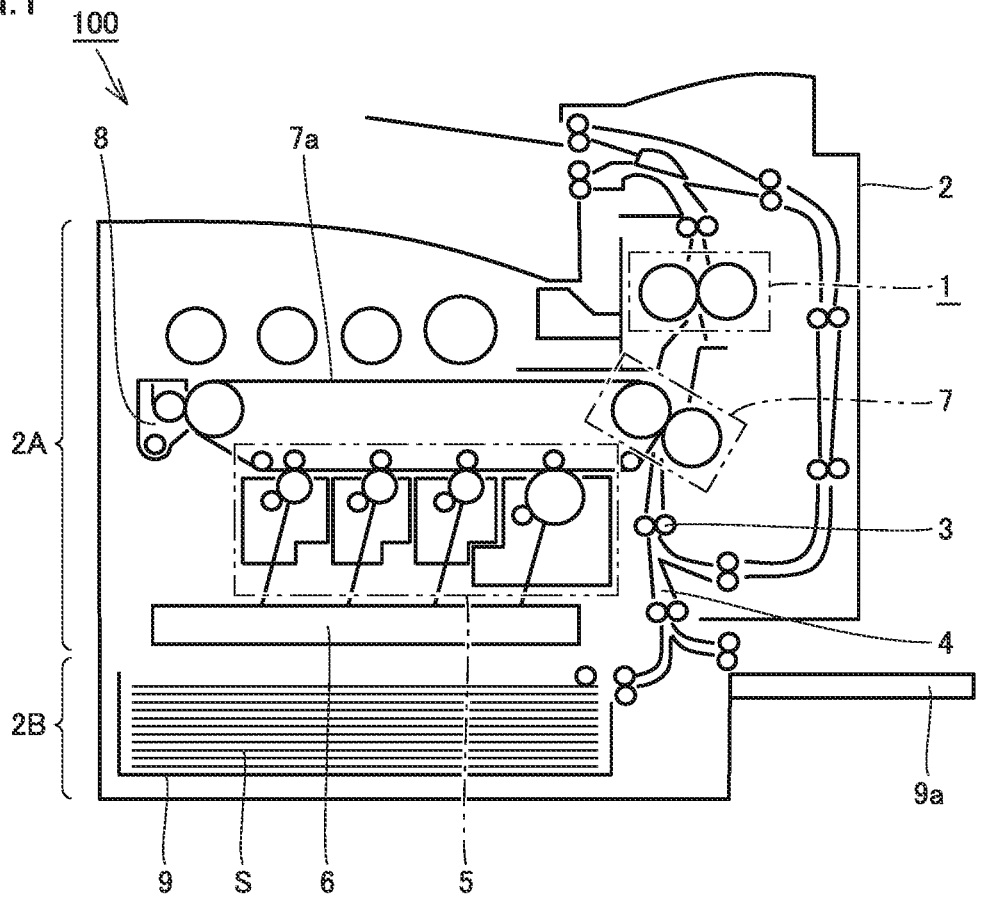
FIG. 1 is a schematic diagram of an image forming apparatus in an embodiment.

Hereinafter, one or more embodiments of the present invention will be described with reference to the drawings. However, the scope of the invention is not limited to the disclosed embodiments.

Each embodiment will be described in detail below with reference to the drawings. In the embodiment shown below, what is called a tandem type electrophotographic color printer and an image forming apparatus equipped therein are exemplified as an image forming apparatus for description. In the embodiment shown below, the same or common elements in the drawings have the same reference characters allotted and description thereof will not be repeated.

First Embodiment

Image Forming Apparatus 100

FIG. 1 is a schematic diagram of an image forming apparatus 100 in an embodiment. A schematic construction of and operations by image forming apparatus 100 in the embodiment will be described with reference to FIG. 1.

Image forming apparatus 100 mainly includes an apparatus main body 2 and an accommodation portion 9. Apparatus main body 2 includes an image forming portion 2A which is a portion for forming an image on paper S as a recording medium and a paper feed portion 2B which is a portion for supplying paper S to image forming portion 2A. Accommodation portion 9 accommodates paper S to be supplied to image forming portion 2A and a fixation apparatus 1 which will be described later, and it is removably provided in paper feed portion 2B.

A plurality of rollers 3 are provided in image forming apparatus 100 so that a transportation path 4 through which paper S is transported along a prescribed direction is defined across image forming portion 2A and paper feed portion 2B described above. As shown in FIG. 1, apparatus main body 2 may separately be provided with a manual feed tray 9*a* for supplying paper S to image forming portion 2A.

Image forming portion 2A mainly includes an imaging unit 5 capable of forming a toner image, for example, of each of yellow (Y), magenta (M), cyan (C), and black (K), an exposure unit 6 for exposing a photoconductor included in imaging unit 5 to light, an intermediate transfer belt 7*a* supported by imaging unit 5 under tension, a transfer portion 7 provided on a track of intermediate transfer belt 7*a* and on transportation path 4, a cleaning portion 8, and fixation apparatus 1 provided on transportation path 4 in a portion downstream from transfer portion 7 which will be described later.

Imaging unit 5 forms a toner image of each of yellow (Y), magenta (M), cyan (C), and black (K) or a toner image only of black (K) on a surface of the photoconductor upon receiving exposure light from exposure unit 6 and transfers the toner image to intermediate transfer belt 7*a* (what is called primary transfer). A colored toner image or a monochrome toner image is thus formed on intermediate transfer belt 7*a*.

Intermediate transfer belt 7*a* moves the colored toner image or the monochrome toner image formed on its surface to transfer portion 7, and it is brought in press contact in transfer portion 7 together with paper S transported from paper feed portion 2B to transfer portion 7. The colored toner image or the monochrome toner image formed on the surface of intermediate transfer belt 7*a* is thus transferred to paper S (what is called secondary transfer).

After transfer portion 7 transfers the colored toner image or the monochrome toner image to paper S, paper S is separated from intermediate transfer belt 7*a* owing to a curvature and cleaning portion 8 removes residual toner from intermediate transfer belt 7*a*.

Paper S to which the colored toner image or the monochrome toner image has been transferred is thereafter pressurized and heated by fixation apparatus 1 so that the toner image formed on paper S is fixed. A finalized color image or a finalized monochrome image is thus formed on paper S and paper S on which the finalized color image or the finalized monochrome image is formed is thereafter ejected from apparatus main body 2.

Fixation Apparatus 1

Figure 2:
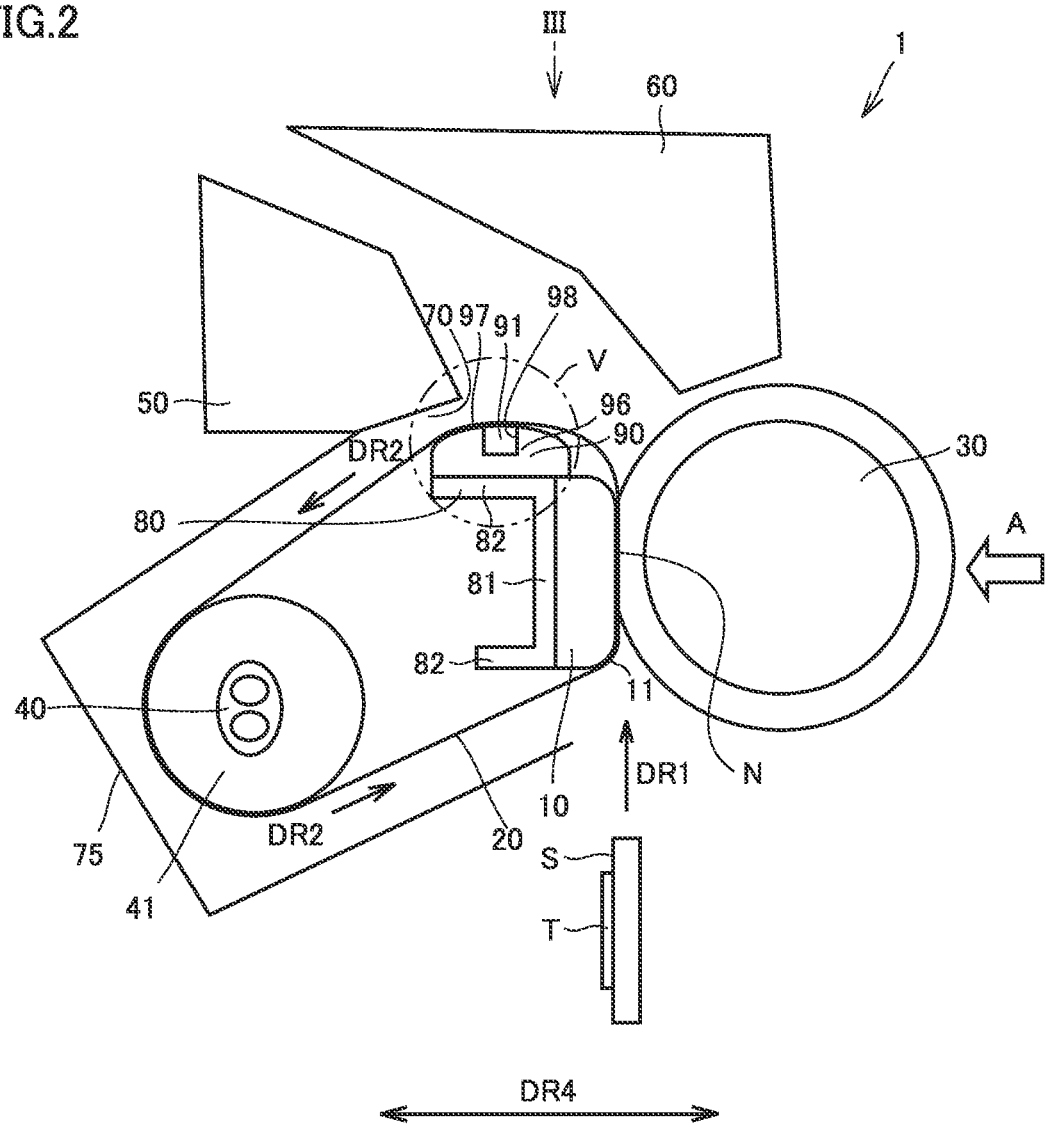
FIG. 2 is a schematic cross-sectional view of a fixation apparatus in a first embodiment.
Figure 3:
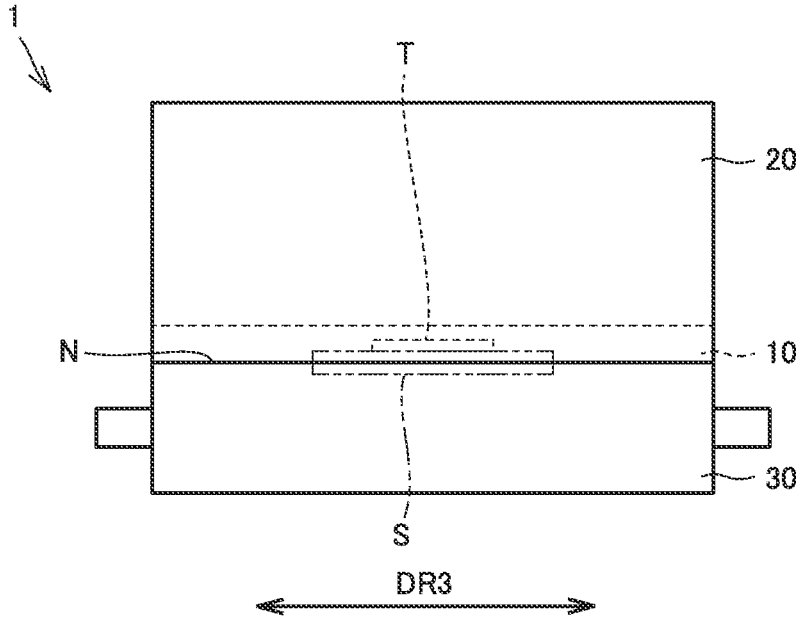
FIG. 3 is a diagram showing overview of a construction of a fixation apparatus viewed in a direction shown with III in FIG. 2.

FIG. 2 is a schematic cross-sectional view of fixation apparatus 1 in a first embodiment. FIG. 3 is a diagram showing overview of a construction of fixation apparatus 1 viewed in a direction shown with III in FIG. 2. For facilitating description, FIG. 3 shows only a pressure roller 30, a pad portion 10, and a fixation belt 20. Fixation apparatus 1 will be described with reference to FIGS. 2 and 3.

Fixation apparatus 1 includes a rotatably constructed endless fixation belt 20, a heat source 40, an opposing rotating body, a tensioned support portion, pad portion 10, an opposing portion 50, a paper ejection guide 60, a housing 75, a fixing member 80, and a support portion 90.

Fixation belt 20 is a fixation belt made of a heat-resistant resin. Fixation belt 20 has any outer diameter (an outer diameter when endless fixation belt 20 is annularly shaped), and the outer diameter is set, for example, to 40 [mm]. Fixation belt 20 has a length in a width direction DR3, for example, of 340 [mm].

A base of fixation belt 20 is composed, for example, of polyimide (PI). The base has a thickness, for example, of 70 [μm]. An outer circumferential surface of the base is covered with heat-resistant silicone rubber having a thickness of 200 [μm]. The base is further covered with a tube of a tetrafluoroethylene-perfluoroalkyl vinyl ether copolymer (PFA) having a thickness of 20 [μm] as a release layer.

Arrows shown in FIG. 2 indicate a direction of transportation DR1, a direction of rotation DR2, and a horizontal direction DR4, respectively. Direction of transportation DR1 refers to a direction of transportation of paper S and is defined as an upward direction in FIG. 2. Direction of rotation D2 refers to a direction of rotation of fixation belt 20. Horizontal direction DR4 refers to a direction orthogonal to direction of transportation DR1 and is defined as a lateral direction in FIG. 2. A double-headed arrow shown in FIG. 3 indicates width direction DR3. Width direction DR3 refers to a width direction of fixation belt 20. Width direction DR3 is defined as a lateral direction in FIG. 3 in parallel to an axial direction of pressure roller 30 and a heating roller 41 which will be described later.

Pad portion 10 is arranged on the inner circumferential side of fixation belt 20. Pad portion 10 slides with respect to the inner circumferential surface of fixation belt 20. Pad portion 10 includes a not-shown base portion and a cover portion.

The base portion is composed of a heat-resistant resin such as a liquid crystal polymer (LCP) and polyphenylene sulfide (PPS). The cover portion covers a side of the base portion opposed to the inner circumferential surface of fixation belt 20. The cover portion is formed, for example, from a polytetrafluoroethylene (PTFE) sheet having a thickness of 100 [μm].

Pad portion 10 includes a curved portion 11 upstream from a fixation nip portion N in direction of transportation DR1. Curved portion 11 is a portion where fixation belt 20 is bent and enters fixation nip portion N. Resistance caused by bending and friction as fixation belt 20 is driven is thus prevented from increasing.

In the embodiment, the opposing rotating body is implemented by pressure roller 30. Pressure roller 30 is rotated by a drive apparatus (not shown) such as a motor. Fixation belt 20 is rotated in direction of rotation DR2 as being driven by rotation of pressure roller 30.

Pressure roller 30 has an outer diameter, for example, of 32 [mm]. Pressure roller 30 is formed as a soft roller by covering a core made of a metal with heat-resistant silicone rubber having a thickness of 3 [mm] and further covering the former with a PFA tube having a thickness of 30 [μm] as a release layer.

Pressure roller 30 presses pad portion 10 with fixation belt 20 being interposed. Pressure roller 30 presses pad portion 10, for example, in horizontal direction DR4 (a hollow arrow A in FIG. 2). Pressure roller 30 defines fixation nip portion N by being opposed to pad portion 10 and the outer circumferential surface of fixation belt 20.

Fixation nip portion N is a region defined by pressing of pad portion 10 by pressure roller 30. In fixation nip portion N, a toner image T on paper S is heated and pressurized and fixed to paper S.

Pad portion 10 is provided as being fixed by fixing member 80. Fixing member 80 is arranged opposite to pressure roller 30 with respect to pad portion 10. Fixing member 80 is formed, for example, by bending a metal plate such as steel electrolytic cold commercial (SECC). Fixing member 80 has a thickness, for example, of 2 [mm].

Fixing member 80 includes a back portion 81 and an orthogonal portion 82. Back portion 81 is in a shape linearly extending in direction of transportation DR1 in a cross-section orthogonal to width direction DR3 (a cross-section Z below). Back portion 81 holds pad portion 10. Back portion 81 receives force applied by pressure roller 30 with pad portion 10 being interposed. A pair of orthogonal portions 82 is provided at opposing ends of back portion 81. Orthogonal portion 82 is in a shape extending in horizontal direction DR4.

By providing back portion 81 and orthogonal portion 82, pad portion 10 which receives force applied by pressure roller 30 can securely be held. Since back portion 81 is flat, pad portion 10 can properly be held without variation or inclination in width direction DR3.

Support portion 90 is arranged downstream from fixation nip portion N (pad portion 10) in direction of rotation DR2. Support portion 90 includes a support surface 97 oriented toward downstream in direction of transportation DR1. Support surface 97 includes a portion in contact with the inner circumferential surface of fixation belt 20. Support surface 97 is in a shape of an arc. Support portion 90 has a length in horizontal direction DR4, for example, of 19 [mm] and a thickness in direction of transportation DR1, for example, of 5 [mm], and support surface 97 has a radius of curvature, for example, of 13 [mm].

Support portion 90 supports fixation belt 20 from the inner circumferential side of fixation belt 20. Support portion 90 includes a base portion 96. Base portion 96 is composed of a heat-resistant resin such as LCP and PPS. A recess 98 is provided in base portion 96. Recess 98 is provided in the center in horizontal direction DR4 of support portion 90. Recess 98 is provided as a recess in support surface 97. Recess 98 has a width in horizontal direction DR4, for example, of 6 [mm] and a depth, for example, of 1.6 [mm].

Support portion 90 further includes a lubricant restriction portion 91. Lubricant restriction portion 91 restricts and stabilizes an amount of attachment of a lubricant onto the inner circumferential surface of fixation belt 20 while it assists support of fixation belt 20 under tension by coming in contact with the inner circumferential surface thereof. A heat-resistant and elastic porous member is preferred for lubricant restriction portion 91, and lubricant restriction portion 91 is made, for example, of an aramid fiber felt. Lubricant restriction portion 91 has a length in horizontal direction DR4, for example, of 6 [mm], and a thickness in direction of transportation DR1, for example, of 2 [mm]. Lubricant restriction portion 91 is attached by being inserted in recess 98 as being collapsed. As lubricant restriction portion 91 is collapsed, support surface 97 and lubricant restriction portion 91 are flush with each other.

A not-shown lubricant is held between pad portion 10 and the inner circumferential surface of fixation belt 20. For example, dimethyl silicone oil and fluorine grease are employed as the lubricant. A lubricant in an amount small enough to form an oil film is held between pad portion 10 and fixation belt 20. Most of remaining lubricant is held in a portion immediately before fixation belt 20 reaches pad portion 10 or held on the inner circumferential surface of fixation belt 20 other than a region lying over pad portion 10. The oil film between pad portion 10 and fixation belt 20 is held by gradual entry of a small amount of lubricant into pad portion 10.

Opposing portion 50 is opposed to support portion 90. A heat-resistant resin such as PPS or PET is employed as a material for opposing portion 50. Opposing portion 50 includes a plurality of ribs in width direction DR3. Opposing portion 50 defines a transportation path for paper S after paper has moved past fixation nip portion N. Opposing portion 50, together with paper ejection guide 60, also serves as a guide for transporting paper S which has moved past fixation nip portion N to a paper ejection portion provided downstream. Details of opposing portion 50 will be described later.

Housing 75 is arranged to surround fixation belt 20. A flow of air along direction of rotation DR2 is formed in housing 75. Air outside housing 75 enters and comes out of housing 75.

The tensioned support portion supports fixation belt 20 under tension. In the first embodiment, the tensioned support portion is implemented by heating roller 41. Heating roller 41, together with pad portion 10 and support portion 90, supports fixation belt 20 under tension. Heating roller 41 presses the inner circumferential surface of fixation belt 20 by means of a tension application mechanism 49 which will be described later to apply tension to fixation belt 20.

Heating roller 41 moves in a direction away from support portion 90 to press the inner circumferential surface of fixation belt 20.

Heating roller 41 contains heat source 40 which heats fixation belt 20. Heat source 40 is implemented, for example, by a halogen lamp. Heat source 40 supplies heat to toner image T with fixation belt 20 being interposed. Fixation apparatus 1 includes a not-shown temperature sensor which senses a temperature of fixation belt 20.

Heating roller 41 is formed as a hard roller, for example, by covering an outer circumferential surface of a hollow cylindrical rotating body formed of aluminum or the like and having a thickness of 0.35 [mm] with a heat-resistant PTFE coating. Heating roller 41 has an outer diameter, for example, of 20 [mm].

Figure 4:
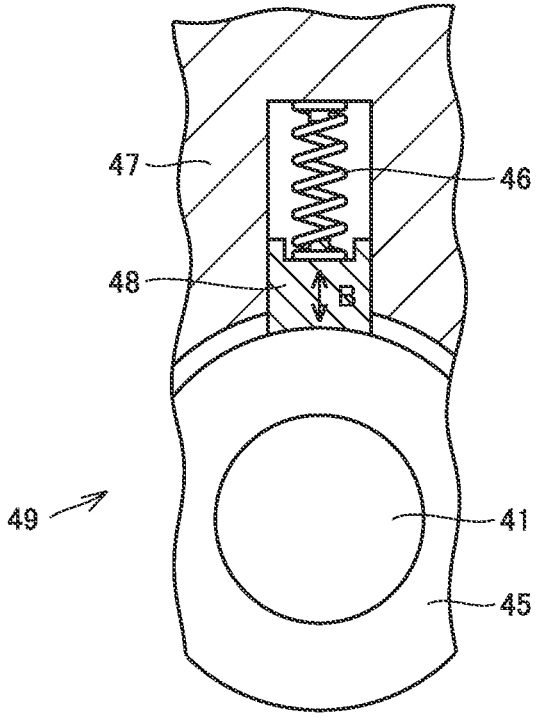
FIG. 4 is a schematic cross-sectional view showing a tension application mechanism in the first embodiment.

FIG. 4 is a schematic cross-sectional view showing tension application mechanism 49 in the first embodiment. Fixation apparatus 1 further includes tension application mechanism 49. Heating roller 41 which rotates at a high temperature is held by tension application mechanism 49. Tension application mechanism 49 is provided and held at an end portion in the axial direction (width direction DR3) of heating roller 41.

Tension application mechanism 49 includes a bush (not shown), a bearing 45, a side plate 47, a helical compression spring 46, and a resin holder 48. Side plate 47 is provided at an end portion in the axial direction of heating roller 41. Bearing 45 is provided in side plate 47. Bearing 45 has an outer diameter, for example, of 32 [mm].

The bush is used for heat insulation. The bush is arranged as being fixed to the end portion of heating roller 41. As the bush is fitted to bearing 45, heating roller 41 is rotatably held. The bush is made of such a heat-resistant resin as polyamide-imide (PAI) and PPS.

Helical compression spring 46 is placed in an opening in side plate 47. Helical compression spring 46 is held between resin holder 48 and the opening in side plate 47. Resin holder 48 is arranged between helical compression spring 46 and bearing 45.

According to the construction, heating roller 41 can move in a direction of extension and contraction of helical compression spring 46 (a direction shown with an arrow B in FIG. 4) and can apply tension to fixation belt 20.

Support Portion 90

Figure 5:
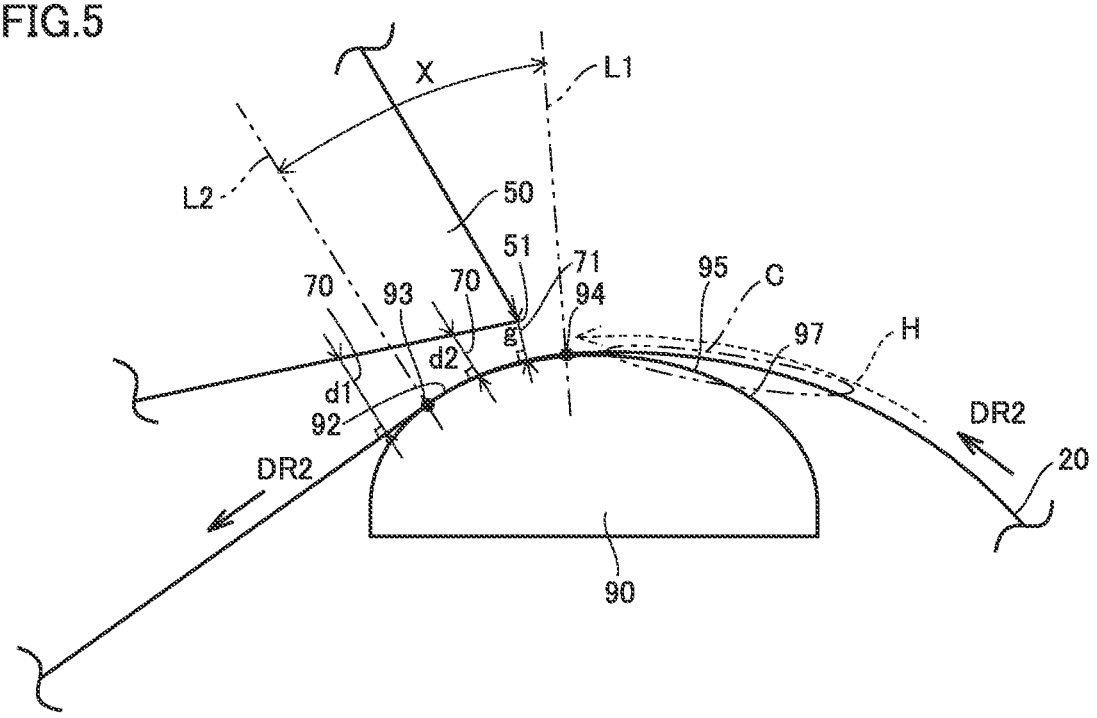
FIG. 5 is an enlarged schematic diagram of a region V shown in FIG. 2.

FIG. 5 is an enlarged schematic diagram of a region V shown in FIG. 2. FIG. 5 does not show recess 98, fixing member 80, and the like. Support portion 90 includes a contact area 92 and an upstream support portion 95. Contact area 92 is a portion where support portion 90 and the inner circumferential surface of fixation belt 20 are in contact with each other. Contact area 92 is in a shape of an arc. Contact area 92 is provided on a downstream side in support surface 97. In contact area 92, fixation belt 20 is less likely to sag, and even when fixation belt 20 is rotating, contact between support portion 90 and the inner circumferential surface of fixation belt 20 is maintained. Contact area 92 is an area where variation in position of fixation belt 20 is less.

In contact area 92, a most downstream contact portion 93 and a most upstream contact portion 94 are defined. Most downstream contact portion 93 is defined in a portion of contact area 92 located most downstream in direction of rotation DR2. Most upstream contact portion 94 is defined in a portion of contact area 92 most upstream in direction of rotation DR2.

Upstream support portion 95 is provided upstream from contact area 92 in direction of rotation DR2. Upstream support portion 95 is in a shape of an arc. Upstream support portion 95 is an area where fixation belt 20 sags. Though a state of contact between support portion 90 and fixation belt 20 is maintained in contact area 92, a state of contact and a state of non-contact between the inner circumferential surface of fixation belt 20 and upstream support portion 95 are repeated in upstream support portion 95 due to sag (a region C in FIG. 5).

Opposing Portion 50

Opposing portion 50 is arranged as being opposed to the outer circumferential surface of fixation belt 20 with a space 70 being interposed. A length of space 70 herein refers to a shortest distance between any portion of opposing portion 50 and the outer circumferential surface of fixation belt 20 (for example, d1 and d2 in FIG. 5).

Opposing portion 50 is arranged as being opposed to contact area 92. A state that "opposing portion 50 is arranged as being opposed to contact area 92" herein refers to such a state that opposing portion 50 is arranged in a region (X in FIG. 5) between a normal (L1 in FIG. 5) orthogonal to a tangential line at most upstream contact portion 94 and a normal (L2 in FIG. 5) orthogonal to a tangential line at most downstream contact portion 93.

Opposing portion 50 includes a tip end portion 51. Tip end portion 51 is provided in a portion of opposing portion 50 closest to the outer circumferential surface of fixation belt 20. A narrowest portion of space 70 (a gap 71 below) is provided between tip end portion 51 and the outer circumferential surface of fixation belt 20. A length (g in FIG. 5) of gap 71 is shortest among lengths of space 70.

Gap 71 is provided in a portion lying over contact area 92. "Gap 71 being provided in a portion lying over contact area 92" herein refers to a state that contact area 92 is arranged on a linear extension which connects tip end portion 51 to the outer circumferential surface of fixation belt 20 over a shortest distance.

Gap 71 is provided in a portion which lies over a portion of contact area 92 closer to most upstream contact portion 94 than to most downstream contact portion 93. "Gap 71 being provided in a portion which lies over a portion of contact area 92 closer to most upstream contact portion 94 than to most downstream contact portion 93" herein refers to a state that an intersection between the straight line which connects tip end portion 51 to the outer circumferential surface of fixation belt 20 over a shortest distance and contact area 92 is closer to most upstream contact portion 94 than to most downstream contact portion 93.

With rotation of fixation belt 20, a flow of air along direction of rotation DR2 is produced (H in FIG. 5). Air flows into space 70 from the upstream side of space 70 in direction of rotation DR2 and enters housing 75 (see FIG. 2). Opposing portion 50 is arranged to block the flow of air into space 70 (housing 75) from the upstream side of space 70 in direction of rotation DR2. Gap 71 prevents flow of air into housing 75.

An ideal length of gap 71 is 0 [mm] from a point of view of suppression of flow-in of air, which will, however, lead to damage to the outer circumferential surface of fixation belt 20. Therefore, a minimum value which allows a non-contact state to be maintained is preferred. Gap 71 has length g, for example, of 1.9 [mm].

An upper limit up to which gap 71 can exhibit an effect of suppression of flow-in of air should only be set to a value allowing suppression of flow of a boundary layer of air along the outer circumferential surface of fixation belt 20. For example, when it is assumed that a speed of fixation belt 20 is set to 240 [mm/s] and a length from fixation nip portion N to tip end portion 51 in direction of rotation DR2 is set to 3 [mm], gap 71 not greater than 6 [mm] can exhibit the effect.

Figure 6:
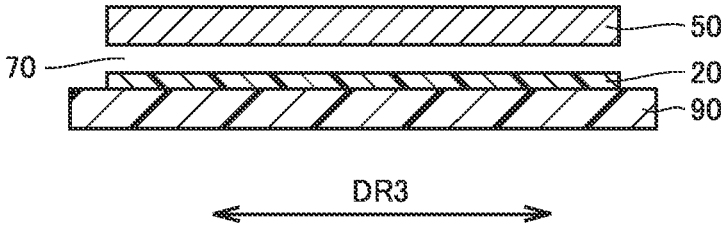
FIG. 6 is a schematic cross-sectional view showing relation among an opposing portion, a fixation belt, and a support portion.

FIG. 6 is a schematic cross-sectional view showing relation among opposing portion 50, fixation belt 20, and support portion 90. Support portion 90 is in contact with fixation belt 20 over its entire surface in width direction DR3. A length of support portion 90 in width direction DR3 is longer than a length of fixation belt 20 in width direction DR3.

Manner of Support Under Tension

Figure 7:
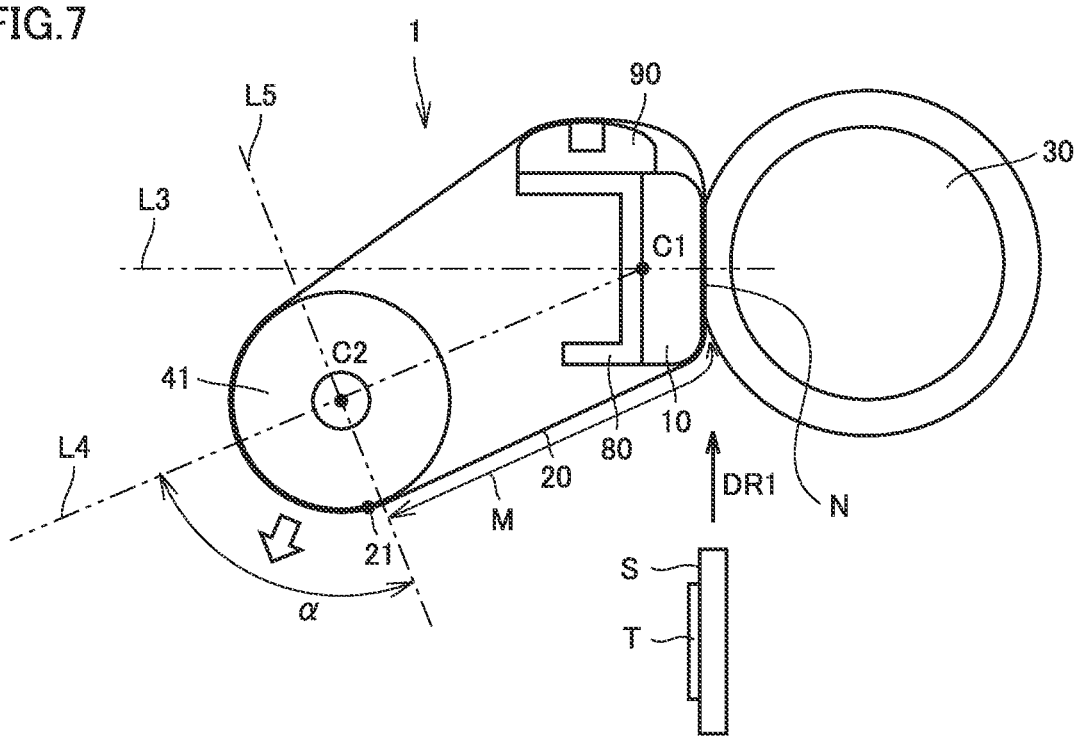
FIG. 7 is a schematic diagram showing a direction of pressing by a heating roller in the first embodiment.

FIG. 7 is a schematic diagram showing a direction of pressing by heating roller 41 in the first embodiment. In FIG. 7, a straight line L3 which passes through a center C1 of pad portion 10 in direction of transportation DR1 and is orthogonal to direction of transportation DR1 in cross-section Z (the cross-section orthogonal to width direction DR3) is defined. Heating roller 41 supports fixation belt 20 under tension by pressing the inner circumferential surface of fixation belt 20 so as to be arranged upstream from straight line L3 in direction of transportation DR1.

In FIG. 7, a straight line L4 which connects center C1 of pad portion 10 to a center C2 of heating roller 41 and a straight line L5 which passes through center C2 of heating roller 41 and is orthogonal to straight line L4 are further defined.

Heating roller 41 presses fixation belt 20 in a direction away from support portion 90 and toward a region defined between straight line L4 and straight line L5 (a range shown with $\alpha$ (not smaller than 0 [°] and not greater than 90 [°]) in FIG. 7) in order to apply component force of tension of fixation belt 20 in a direction along straight line L4 and outward from fixation belt 20. Heating roller 41 presses fixation belt 20 in a direction away from support portion 90 and toward upstream in direction of transportation DR1.

A contact downstream end 21 is defined in fixation belt 20. Contact downstream end 21 is provided most downstream in direction of rotation DR2 in a portion of contact between fixation belt 20 and heating roller 41. When a length from contact downstream end 21 in direction of rotation DR2 to fixation nip portion N (M in FIG. 7) is short, a time period until fixation belt 20 heated by heating roller 41 enters fixation nip portion N becomes shorter.

Figure 8:
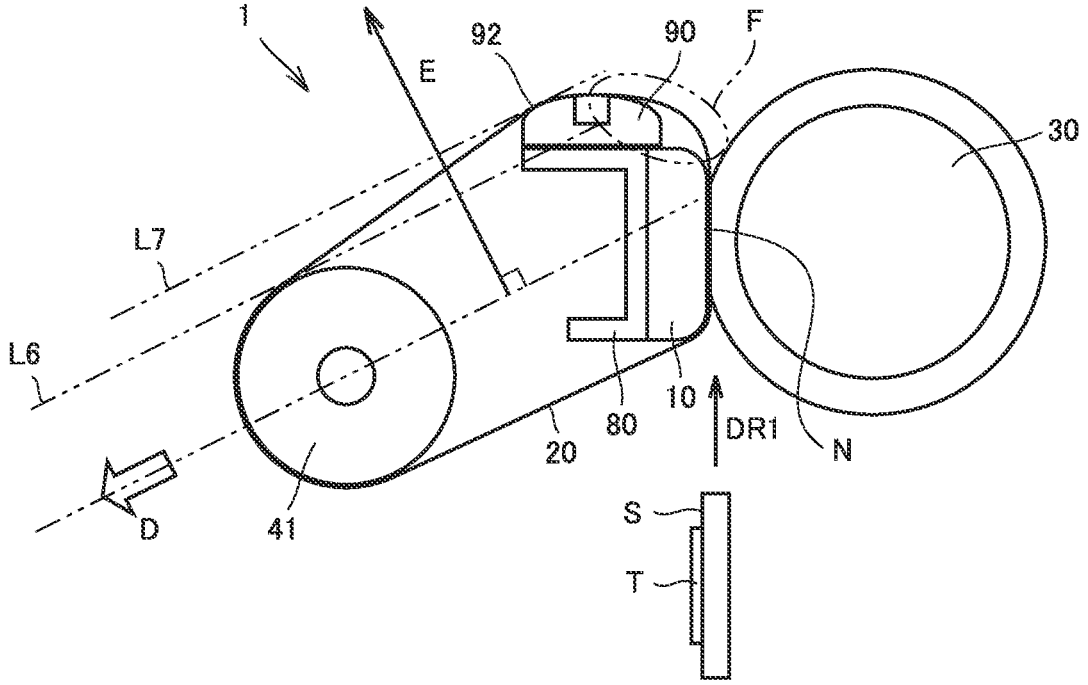
FIG. 8 is a schematic diagram showing relation between the direction of pressing by the heating roller and a position of the support portion in the first embodiment.

FIG. 8 is a schematic diagram showing relation between the direction of pressing by heating roller 41 and a position of support portion 90 in the first embodiment. Support portion 90 projects outward most in a direction (a direction shown with an arrow E in FIG. 8) perpendicular to the direction of pressing by heating roller 41 (a hollow arrow D in FIG. 8) and toward downstream in direction of transportation DR1. In the direction shown with arrow E, contact area 92 is arranged downstream from heating roller 41 in direction of transportation DR1. A location where fixation belt 20 sags is thus limited to an area between fixation nip portion N and contact area 92 (a region F in FIG. 8).

In FIG. 8, a straight line L6 which is in parallel to the direction of pressing of the inner circumferential surface of fixation belt 20 by heating roller 41 (hollow arrow D in FIG. 8) and in contact with heating roller 41 and a straight line L7 which is in parallel to straight line L6 and in contact with contact area 92 are defined. In the direction shown with arrow E, straight line L7 is defined downstream from straight line L6 in direction of transportation DR1.

Function and Effect

As shown in FIG. 5, by arranging opposing portion 50 as being opposed to support portion 90, a flow of air into space 70 (an arrow H in FIG. 5) from the upstream side of space 70 in direction of rotation DR2 can be suppressed. By arranging opposing portion 50 as being opposed to support portion 90, entry of air into housing 75 as being led by the outer circumferential surface of fixation belt 20 with rotation of fixation belt 20 can be suppressed.

By arranging opposing portion 50 as being opposed to contact area 92 where fixation belt 20 is less likely to sag, opposing portion 50 can be arranged without taking sag into account. A length of space 70 can thus be short.

Therefore, entry into housing 75 of air relatively low in temperature on the downstream side of fixation nip portion N in direction of transportation DR1 (upstream from space 70 in direction of rotation DR2) can be suppressed. Therefore, lowering in temperature of fixation belt 20 can be suppressed and energy efficiency of fixation apparatus 1 can be ensured.

Opposing portion 50 is arranged to block a flow of air into space 70 from the upstream side of space 70 in direction of rotation DR2. Flow-in of air relatively low in temperature can thus be suppressed. Therefore, lowering in temperature of fixation belt 20 can be suppressed.

A narrowest portion of space 70 (gap 71) is provided in a portion lying over contact area 92. Entry into housing 75 of air relatively low in temperature from the upstream side of space 70 in direction of rotation DR2 can thus effectively be suppressed.

Gap 71 is provided in a portion lying over a portion of contact area 92 closer to most upstream contact portion 94 than to most downstream contact portion 93. A flow of air can thus be suppressed at a further upstream position. Therefore, lowering in temperature of fixation belt 20 can effectively be suppressed.

As shown in FIG. 2, opposing portion 50 defines a path for paper S after paper has moved past fixation nip portion N. As opposing portion 50 serves to define gap 71 and also to guide paper S, manufacturing cost can be suppressed.

As shown in FIG. 7, heating roller 41 supports fixation belt 20 under tension by pressing the inner circumferential surface of fixation belt 20 so as to be arranged upstream from straight line L3 in direction of transportation DR1. A length (M in FIG. 7) from contact downstream end 21 in direction of rotation DR2 to fixation nip portion N can thus be made shorter. Therefore, heat from heating roller 41 can efficiently conduct to fixation nip portion N through fixation belt 20.

As shown in FIG. 8, in the direction of pressing of the inner circumferential surface of fixation belt 20 by the tensioned support portion (hollow arrow D in FIG. 8) which is orthogonal to the width direction of fixation belt 20, contact area 92 is provided downstream from heating roller 41 in direction of transportation DR1. Contact area 92 can thus reliably be formed.

Contact area 92 is in a shape of an arc. Increase in sliding resistance between support portion 90 and fixation belt 20 can thus be suppressed.

Second Embodiment

Figure 9:
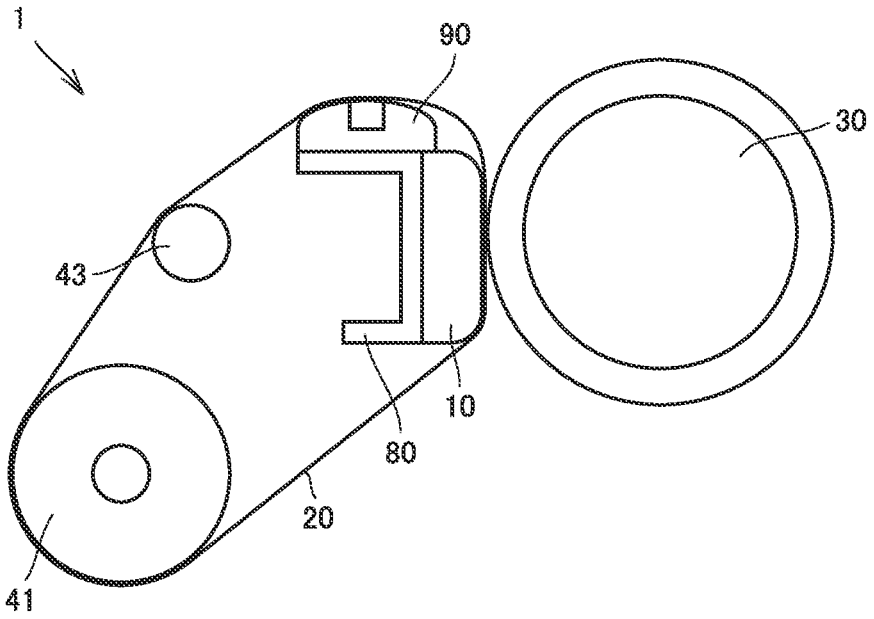
FIG. 9 is a schematic diagram showing the fixation apparatus in a second embodiment.

FIG. 9 is a schematic diagram showing fixation apparatus 1 in a second embodiment. The tensioned support portion in the second embodiment further includes a tensioned support assistance roller 43. Other features are the same as those in fixation apparatus 1 in the first embodiment. Tensioned support assistance roller 43 and heating roller 41 apply tension to fixation belt 20.

Fixation apparatus 1 in the second embodiment also achieves an effect of suppression of lowering in temperature of fixation belt 20 as in the first embodiment.

Third Embodiment

Figure 10:
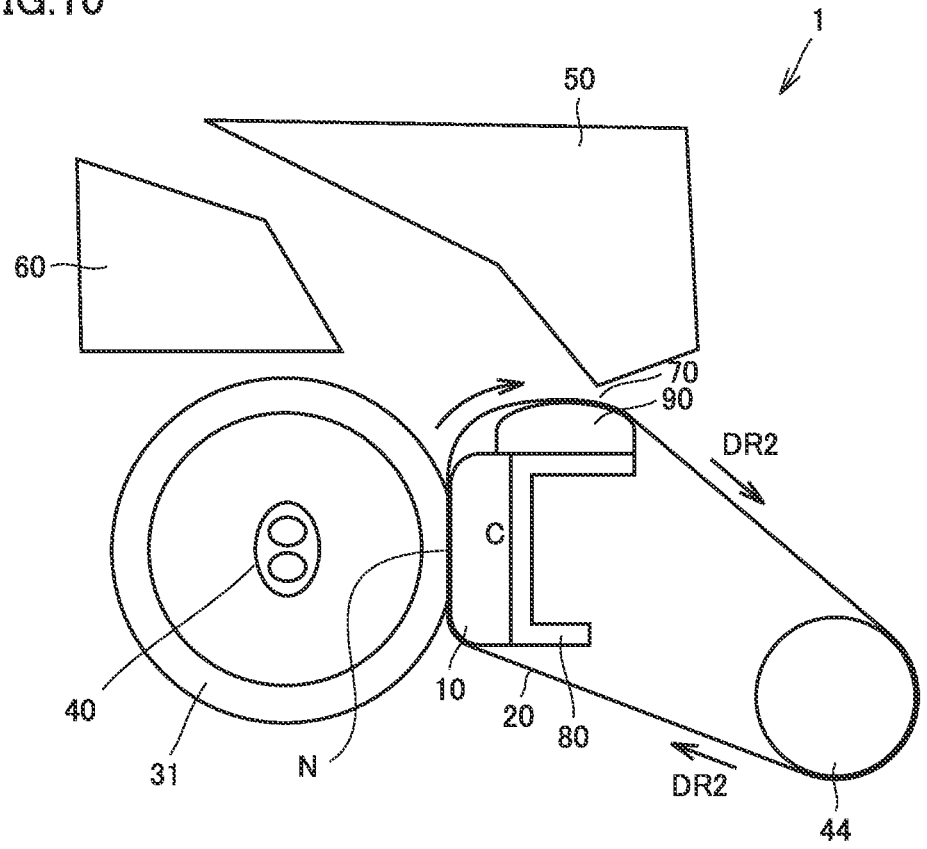
FIG. 10 is a schematic diagram showing the fixation apparatus in a third embodiment.

FIG. 10 is a schematic diagram showing fixation apparatus 1 in a third embodiment. The opposing rotating body in the third embodiment is implemented by an opposing roller 31 containing heat source 40. In the third embodiment, the tensioned support portion is implemented by a tensioned support roller 44. Other features are the same as those in fixation apparatus 1 in the first embodiment. Tensioned support roller 44 applies tension to fixation belt 20. Tensioned support roller 44, support portion 90, and pad portion 10 support fixation belt 20 under tension.

Fixation apparatus 1 in the third embodiment also achieves an effect of suppression of lowering in temperature of fixation belt 20 as in the first embodiment.

Fourth Embodiment

Figure 11:
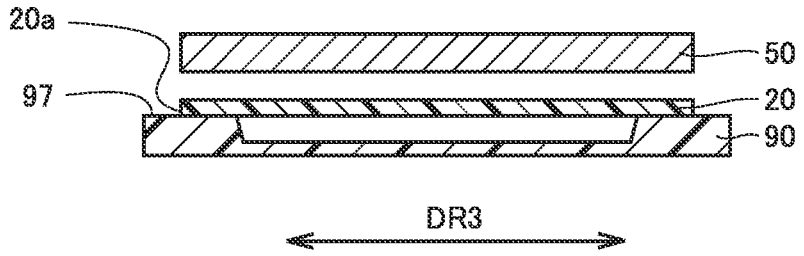
FIG. 11 is a schematic cross-sectional view showing the support portion in a fourth embodiment.

FIG. 11 is a schematic cross-sectional view showing support portion 90 in a fourth embodiment. Though support portion 90 supports fixation belt 20, the entire support surface 97 of support portion 90 does not have to be in contact with fixation belt 20. Support surface 97 should only hold a part of fixation belt 20, that is, at least an end portion 20*a* of fixation belt 20 in width direction DR3. According to the construction, displacement of fixation belt 20 can be suppressed.

Fixation apparatus 1 in the fourth embodiment also achieves an effect of suppression of lowering in temperature of fixation belt 20 as in the first embodiment.

Fifth Embodiment

Figure 12:
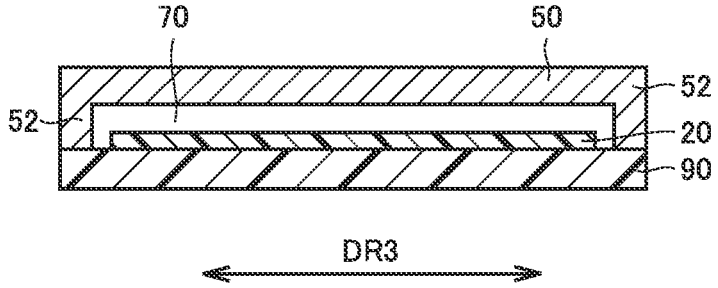
FIG. 12 is a schematic cross-sectional view showing the support portion in a fifth embodiment.

FIG. 12 is a schematic cross-sectional view showing support portion 90 in a fifth embodiment. Opposing portion 50 is fixed to support portion 90 on an outer side of fixation belt 20 in width direction DR3. A length of opposing portion 50 in width direction DR3 is longer than a length of fixation belt 20 in width direction DR3. Opposing portion 50 includes a pair of abutting portions 52 at opposing ends in width direction DR3. Opposing portion 50 is attached to support portion 90 at abutting portion 52.

Accuracy in positioning between support portion 90 and opposing portion 50 can thus be enhanced. Therefore, a dimension tolerance between support portion 90 and opposing portion 50 can be minimized and smaller gap 71 can be set.

Others

For example, an induction heat generator including an excitation coil may be employed as heating means for heating fixation belt 20. Heating means does not necessarily have to be arranged in heating roller 41 but may be arranged anywhere.

Flow into the fixation apparatus from a downstream side of a fixation nip portion may occur. Then, a temperature of the fixation belt may be lowered and energy efficiency may become poor.

A fixation apparatus according to the present embodiment fixes a toner image formed on a recording medium. The fixation apparatus includes an endless fixation belt, a pad portion, an opposing rotating body, a heat source, a tensioned support portion, a support portion, and an opposing portion. The fixation belt is rotatably constructed. The pad portion is arranged on an inner circumferential side of the fixation belt. The opposing rotating body is opposed to the pad portion and an outer circumferential surface of the fixation belt to form a fixation nip portion. The heat source supplies heat to the toner image. The tensioned support portion supports the fixation belt under tension. The support portion is arranged downstream from the fixation nip portion in a direction of rotation of the fixation belt and supports the fixation belt from the inner circumferential side of the fixation belt. The opposing portion is arranged as being opposed to the outer circumferential surface of the fixation belt with a space being interposed. The support portion includes a contact area where the support portion and an inner circumferential surface of the fixation belt are in contact with each other. The opposing portion is arranged as being opposed to the contact area.

In the fixation apparatus, the opposing portion is arranged to block a flow of air into the space from an upstream side of the space in the direction of rotation.

In the fixation apparatus, a narrowest portion of the space is provided in a portion lying over the contact area.

In the fixation apparatus, in the contact area, a most downstream contact portion is provided in a portion of the contact area located most downstream in the direction of rotation and a most upstream contact portion is provided in a portion of the contact area located most upstream in the direction of rotation. The narrowest portion of the space is provided in a portion lying over a portion of the contact area closer to the most upstream contact portion than to the most downstream contact portion.

In the fixation apparatus, the opposing portion defines a transportation path for the recording medium after the recording medium has moved past the fixation nip portion.

In the fixation apparatus, in a cross-section orthogonal to a width direction of the fixation belt, a straight line which passes through a center of the pad portion in a direction of transportation of the recording medium and is orthogonal to the direction of transportation is defined. The tensioned support portion supports the fixation belt under tension by pressing the inner circumferential surface of the fixation belt so as to be arranged upstream from the straight line in the direction of transportation.

In the fixation apparatus, in a direction of pressing of the inner circumferential surface of the fixation belt by the tensioned support portion which is orthogonal to a width direction of the fixation belt, the contact area is provided downstream from the tensioned support portion in the direction of transportation.

In the fixation apparatus, the contact area is in a shape of an arc.

In the fixation apparatus, the support portion includes an upstream support portion in a shape of an arc which is located upstream from the contact area in the direction of rotation.

In the fixation apparatus, the opposing portion is fixed to the support portion on an outer side of the fixation belt in a width direction of the fixation belt.

An image forming apparatus according to the present embodiment includes the fixation apparatus in any aspect above and an accommodation portion which accommodates a recording medium to be transported to the fixation apparatus.

The present disclosure provides a fixation apparatus and an image forming apparatus capable of achieving suppression of lowering in temperature of a fixation belt due to flow-in of air.

Although embodiments of the present invention have been described and illustrated in detail, the disclosed embodiments are made for the purposes of illustration and example only and not limitation. The scope of the present invention should be interpreted by terms of the appended claims.

What is claimed is:

1. A fixation apparatus for fixing a toner image formed on a recording medium, the fixation apparatus comprising:

a rotatably constructed endless fixation belt;

a pad portion arranged on an inner circumferential side of the fixation belt;

an opposing rotating body opposed to the pad portion and an outer circumferential surface of the fixation belt to form a fixation nip portion;

a heat source which supplies heat to the toner image;

a tensioning portion which supports the fixation belt under tension;

a support portion arranged downstream from the fixation nip portion in a direction of rotation of the fixation belt, the support portion supporting the fixation belt from the inner circumferential side of the fixation belt; and an opposing portion arranged as being opposed to the outer circumferential surface of the fixation belt with a space being interposed, the support portion including a contact area where the support portion and an inner circumferential surface of the fixation belt are in contact with each other, the opposing portion being arranged as being opposed to the contact area, the pad portion and the support portion being separately in contact with the fixation belt, and the opposing portion including a pair of abutting portions at opposing ends in a width direction, and the opposing portion being attached to the support portion at the abutting portions so that a gap is formed between the opposing portion and the support portion.

2. The fixation apparatus according to claim 1, wherein the opposing portion is arranged to block a flow of air into the space from an upstream side of the space in the direction of rotation.

3. The fixation apparatus according to claim 1, wherein a narrowest portion of the space is provided in a portion lying over the contact area.

4. The fixation apparatus according to claim 3, wherein in the contact area, a most downstream contact portion is provided in a portion of the contact area located most downstream in the direction of rotation and a most upstream contact portion is provided in a portion of the contact area located most upstream in the direction of rotation, and the narrowest portion of the space is provided in a portion lying over a portion of the contact area closer to the most upstream contact portion than to the most downstream contact portion.

5. The fixation apparatus according to claim 1, wherein the opposing portion defines a transportation path for the recording medium after the recording medium has moved past the fixation nip portion.

6. The fixation apparatus according to claim 1, wherein in a cross-section orthogonal to a width direction of the fixation belt, a straight line which passes through a center of the pad portion in a direction of transportation of the recording medium and is orthogonal to the direction of transportation is defined, and the tensioning portion supports the fixation belt under tension by pressing the inner circumferential surface of the fixation belt so as to be arranged upstream from the straight line in the direction of transportation.

7. The fixation apparatus according to claim 1, wherein in a direction of pressing of the inner circumferential surface of the fixation belt by the tensioning portion which is orthogonal to a width direction of the fixation belt, the contact area is provided downstream from the tensioning portion in a direction of transportation of the recording medium.

8. The fixation apparatus according to claim 1, wherein the contact area is in a shape of an arc.

9. The fixation apparatus according to claim 1, wherein the support portion includes an upstream support portion in a shape of an arc which is located upstream from the contact area in the direction of rotation.

10. An image forming apparatus comprising:

a fixation apparatus which fixes a toner image formed on a recording medium; and an accommodation portion which accommodates the recording medium to be transported to the fixation apparatus, the fixation apparatus including a rotatably constructed endless fixation belt, a pad portion arranged on an inner circumferential side of the fixation belt, an opposing rotating body opposed to the pad portion and an outer circumferential surface of the fixation belt to form a fixation nip portion, a heat source which supplies heat to the toner image, a tensioning portion which supports the fixation belt under tension, a support portion arranged downstream from the fixation nip portion in a direction of rotation of the fixation belt, the support portion supporting the fixation belt from the inner circumferential side of the fixation belt, and an opposing portion arranged as being opposed to the outer circumferential surface of the fixation belt with a space being interposed, the support portion including a contact area where the support portion and an inner circumferential surface of the fixation belt are in contact with each other, the opposing portion being arranged as being opposed to the contact area, the pad portion and the support portion being separately in contact with the fixation belt, the opposing portion including a pair of abutting portions at opposing ends in a width direction, and the opposing portion being attached to the support portion at the abutting portions so that a gap is formed between the opposing portion and the support portion.

11. The fixation apparatus according to claim 1, wherein the pad portion and the support portion are separate components connected to one another via a fixing member.

12. The fixation apparatus according to claim 1, wherein the support portion contains a heat-resistant and elastic porous member.

13. The fixation apparatus according to claim 1, wherein the support portion has a surface section that is concave-shaped in a width direction of the support portion.

* * * * *